US006547386B2

(12) United States Patent
Bermel et al.

(10) Patent No.: US 6,547,386 B2
(45) **Date of Patent: *Apr. 15, 2003**

(54) INK JET PRINTING METHOD

(75) Inventors: Alexandra D. Bermel, Pittsford, NY (US); Lori J. Shaw-Klein, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 99 days.

This patent is subject to a terminal disclaimer.

(21) Appl. No.: 09/771,189

(22) Filed: Jan. 26, 2001

(65) Prior Publication Data

US 2002/0140795 A1 Oct. 3, 2002

(51) Int. Cl.[7] ..... B41J 2/01
(52) U.S. Cl. ..... 347/105; 428/195
(58) Field of Search ..... 428/195, 422, 428/500, 323, 328; 347/105, 106

(56) References Cited

U.S. PATENT DOCUMENTS 5,827,363 A * 10/1998 Darsillo et al. ..... 106/484
6,037,050 A 3/2000 Saito et al.
6,403,162 B1 * 6/2002 Tokunaga et al. ..... 427/379
6,409,334 B1 * 6/2002 Campbell et al. ..... 347/106

FOREIGN PATENT DOCUMENTS

EP 0888904 A1 1/1999

OTHER PUBLICATIONS

Product Bulletin: MOWIOL PVA (sections B, D, G), Clariant Corp. (1999).*
Product Bulletin, HP Photosmart 1215 Printer (retrieved from Hewlett–Pacard website (www.pandi.itrc.hp.com); site visited Jun. 30, 2002.*
Product Bulletins: Aerosil Mox 180 and Aerosil Mox 170 fumed pigments, retrieved from Degussa Corp Website (www.aerosil.com), site visited Jun. 30, 2002.*

* cited by examiner

*Primary Examiner*—Bruce H. Hess
*Assistant Examiner*—Michael E. Grendzynski
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with an ink jet recording element comprising a support having thereon a porous image-receiving layer comprising particles and a poly(vinyl alcohol) binder, the particles comprising a fumed metallic oxide, and the binder having an average viscosity greater than about 25 cp at 4% solids in an aqueous solution at 20° C.;

C) loading the printer with an ink jet ink composition; and

D) printing on the image-receiving layer using the ink jet ink composition in response to the digital data signals.

8 Claims, No Drawings

INK JET PRINTING METHOD

CROSS REFERENCE TO RELATED APPLICATIONS

Reference is made to commonly assigned, co-pending U.S. Patent Applications:

Ser. No. 09/770,814 by Bermel et al., filed Jan. 26, 2001 entitled "Ink Jet Recording Element";
Ser. No. 09/771,191 by Bermel et al., filed Jan. 26, 2001 entitled "Ink Jet Recording Element";
Ser. No. 09/770,429 by Bermel et al., filed Jan. 26, 2001 entitled "Ink Jet Recording Element";
Ser. No. 09/770,782 by Bermel et al., filed Jan. 26, 2001 entitled "Ink Jet Printing Method";
Ser. No. 09/770,433 by Bermel et al., filed Jan. 26, 2001 entitled "Ink Jet Printing Method";
Ser. No. 09/770,807 by Bermel et al., filed Jan. 26, 2001 entitled "Ink Jet Printing Method";
Ser. No. 09/770,728 by Bermel et al., filed Jan. 26, 2001 entitled "Ink Jet Printing Method";
Ser. No. 09/770,128 by Lawrence et al., filed Jan. 26, 2001 entitled "Ink Jet Printing Method";
Ser. No. 09/770,127 by Lawrence et al., filed Jan. 26, 2001 entitled "Ink Jet Printing Method";
Ser. No. 09/770,781 by Lawrence et al., filed Jan. 26, 2001 entitled "Ink Jet Printing Method";
Ser. No. 09/771,251 by Lawrence et al., filed Jan. 26, 2001 entitled "Ink Jet Printing Method";
Ser. No. 09/770,122 by Lawrence et al., filed Jan. 26, 2001 entitled "Ink Jet Printing Method";
Ser. No. 09/772,097 by Lawrence et al., filed Jan. 26, 2001 entitled "Ink Jet Printing Method"; and

FIELD OF THE INVENTION

Ser. No. 09/770,431 by Lawrence et al., filed Jan. 26, 2001 entitled "Ink Jet Printing Method".

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

When a porous recording element is manufactured, it is difficult to co-optimize the image-receiving layer surface appearance and ink drying times. Good image-receiving layer surface appearance is obtained when it is virtually crack-free. A crack-free surface appearance can be obtained merely by adding more binder to the image-receiving layer. However, adding more binder increases dry time since the binder fills the pores in the image-receiving layer. Therefore, it is difficult to obtain an image-receiving layer which has a crack-free surface yet is fast-drying.

U.S. Pat. No. 6,037,050 and EP 888,904 relate to an ink jet recording element wherein an ink absorption layer comprises inorganic particles such as silica and a poly(vinyl alcohol) binder that is crosslinked with a hardener. However, there is no disclosure in these references that the poly(vinyl alcohol) binder should have a certain viscosity or that the inorganic particles comprise a fumed metallic oxide.

It is an object of this invention to provide a method for using a porous ink jet recording element that exhibits good overall appearance without cracking and has an excellent dry time.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an ink jet recording element comprising a support having thereon a porous image-receiving layer comprising particles and a poly(vinyl alcohol) binder, the particles comprising a fumed metallic oxide, and the binder having an average viscosity greater than about 25 cp at 4% solids in an aqueous solution at 20° C.;

C) loading the printer with an ink jet ink composition; and

D) printing on the image-receiving layer using the ink jet ink composition in response to the digital data signals.

By use of the process of the invention, a porous ink jet recording element is obtained that exhibits good overall appearance without cracking and has an excellent dry time.

DETAILED DESCRIPTION OF THE INVENTION

Any fumed metallic oxide particles may be used in the invention. Examples of such particles include fumed alumina, silica, titania, cationic silica, antimony(III) oxide, chromium(III) oxide, iron(III) oxide, germanium(IV) oxide, vanadium(V) oxide, or tungsten(VI) oxide. In a preferred embodiment, fumed alumina, fumed silica or cationic fumed silica is employed. Fumed oxides are available in dry form or as dispersions. The fumed metallic oxide particles may be porous or nonporous.

The fumed metallic oxide particles used in the invention may be in the form of primary particles or in the form of secondary aggregated particles. Preferred aggregates are comprised of smaller primary particles about 7 to about 40 nm in diameter and are aggregated up to about 300 nm in diameter. The pores in a dried coating of such aggregates fall within the range necessary to ensure low optical scatter yet sufficient ink solvent uptake.

The process for fuming metallic oxides is well known in the art. For example, reference may be made to Technical Bulletin Pigments, no. 56, Highly Dispersed Metallic Oxides Produced by the AEROSIL® Process, by Degussa AG., 1995.

Porosity of an image-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small that they do not scatter visible light.

As noted above, the poly(vinyl alcohols) useful in the invention have an average viscosity greater than about 25 cp when employed in a 4% aqueous solids solution at 20° C. Specific examples of such poly(vinyl alcohols) which may be used in the invention include the following:

TABLE 1

| | Poly (vinyl alcohol) | Average Viscosity @ 4% (cp)* |
|---|---|---|
| PVA-A | Gohsenol ® GH-17 | 30 |
| PVA-B | Gohsenol ® GH-23 | 52 |
| PVA-C | Gohsenol ® N300 | 27.5 |

*Trade publication, Nippon Gohsei Co., Ltd.

The amount of poly(vinyl alcohol) binder used should be sufficient to impart cohesive strength to the image-receiving layer, but as small as possible so that the interconnected pore structure formed by the aggregates is not filled in by the binder. In a preferred embodiment of the invention, the weight ratio of the binder to the particles is from about 1:20 to about 1:5.

The image-receiving layer may also contain a mordant and/or a crosslinker for crosslinking the poly(vinyl alcohol). Examples of mordants which may be used include water-soluble cationic polymers, metal salts, water-insoluble cationic polymeric particles in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyper-branched, grafted, random, blocked, or can have other polymer microstructures well known to those in the art. They also can be partially crosslinked. Examples of core/shell particles useful in the invention are disclosed and claimed in U.S. patent application Ser. No. 09/772,097, of Lawrence et al., Ink Jet Printing Method, filed of even date herewith, the disclosure of which is hereby incorporated by reference. Examples of water dispersible particles useful in the invention are disclosed and claimed in U.S. patent application Ser. No. 09/770,128 of Lawrence et al., Ink Jet Printing Method, filed Jan. 26, 2001; and U.S. patent application Ser. No. 09/770,127 of Lawrence et al., Ink Jet Printing Method, filed Jan. 26, 2001, the disclosures of which are hereby incorporated by reference.

Examples of crosslinkers which may be used include carbodiimides, polyfunctional aziridines, aldehydes, isocyanates, epoxides, polyvalent metal cations, acetals, ketals, etc. In a preferred embodiment of the invention, the crosslinker is an aldehyde, an acetal or a ketal. In a more preferred embodiment, the crosslinker is 2,3-dihydroxy-1,4-dioxane.

Since the image-receiving layer is a porous layer comprising particles, the void volume must be sufficient to absorb all of the printing ink. For example, if a porous layer has 60 volume % open pores, in order to instantly absorb 32 $cc/m^2$ of ink, it must have a physical thickness of at least about 54 $\mu$m.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene, polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements used in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946, 4,239,543 and 4,781,758, the disclosures of which are hereby incorporated by reference.

The following example is provided to illustrate the invention.

EXAMPLE

The following are comparative poly(vinyl alcohols) used which have an average viscosity of less than 25 cp at a 4% aqueous solution at 20° C.:

TABLE 2

| | Poly (vinyl alcohol) | Average Viscosity @ 4% cp |
|---|---|---|
| C-1 | Gohsenol ® GL-05 | 5.3[1] |
| C-2 | Gohsenol ® GM-14 | 22.5[1] |
| C-3 | Elvanol ® 52-22 | 23.5[2] |

[1]Trade publication, Nippon Gohsei Co., Ltd.
[2]Trade publication, DuPont Corp.

Element 1 of the Invention

A coating solution was prepared by combining fumed alumina (Cab-O-Sperse® PG003, Cabot Corp.), PVA-A and crosslinker 2,3-dihydroxy-1,4-dioxane (Clariant Corp.) in a ratio of 86:12:2 to give an aqueous coating formulation of 30% solids by weight. The layer was bead-coated at 40° C. on polyethylene-coated paper base which had been previously subjected to corona discharge treatment. The coating was then dried at 60° C. by forced air to yield a recording element with a thickness of 40 $\mu$m.

Element 2 of the Invention

This element was prepared the same as Element 1 except that PVA-B was used instead of PVA-A.

Element 3 of the Invention

This element was prepared the same as Element 1 except that PVA-C was used instead of PVA-A.

Element 4 of the Invention

This element was prepared the same as Element 2 except that fumed silica, CEP10AK97001, aqueous dispersion, (Cabot Corp.) was used instead of fumed alumina.

Element 5 of the Invention

This element was prepared the same as Element 2 except that cationic fumed silica, CEP10AK97006, aqueous dispersion, (Cabot Corp.) was used instead of fumed alumina.

Comparative Element C-1

This element was prepared the same as Element 1 except that C-2 was used instead of PVA-A.

Comparative Element C-2

This element was prepared the same as Element 1 except that C-2 was used instead of PVA-A.

Comparative Element C-3

This element was prepared the same as Element 4 except that C-3 was used instead of PVA-A.

Comparative Element C-4

This element was prepared the same as Element 2 except that colloidal alumina, Dispal® 11N7-80, alumina powder, (Condea Vista Co.) was used instead of fumed alumina.

Coating Quality

The above dried coatings were visually evaluated for cracking defects and were rated as follows:

0=no cracking
1=slight cracking at the coating edges
2=cracking at the coating edges
3=cracking throughout the coating
4=sample severely cracked throughout the coating
5=sample severely cracked and flaked off the support

TABLE 3

| Recording Element | Cracking Rating |
|---|---|
| 1 | 0 |
| 2 | 0 |
| 3 | 0 |
| 4 | 0 |
| 5 | 0 |
| C-1 | 5 |
| C-2 | 2 |
| C-3 | 2 |
| C-4 | 0 |

The above results show that the image-receiving layer of the elements employed in the process of the invention did not crack. Although the image-receiving layer of comparative element C-4 also did not crack, it had other problems as will be shown below in Table 4.

Dry Time

Test images of cyan, magenta, yellow, red, green, blue and black bars, each 1.1 cm by 13.5 cm, were printed on the above elements using an Epson Stylus® Photo 870 using inks with catalogue number T008201. Immediately after ejection from the printer, a piece of bond paper was placed over the printed image and rolled with a smooth, heavy weight. Then the bond paper was separated from the printed image. Ink transferred to the bond paper if the recording element was not dry. The length of the bar imaged on the bond paper was measured and is proportional to the dry time. Dry times corresponding to a length of about 40 cm or less are acceptable.

TABLE 4

| Recording Element | Proportional Dry Time (cm) |
|---|---|
| 1 | 34 |
| 2 | 17 |
| 3 | 27 |
| 4 | 0 |
| C-1 | * |
| C-2 | 29.5 |
| C-3 | 0 |
| C-4 | 65 |

*Was too cracked to print on to get a measurement

The above results show that the elements employed in the process of the invention had better dry times than all the comparative elements except for C-3. However, C-3 had other problems as shown above in Table 3. Only the recording elements employed in the process of the invention were good for both cracking and dry time.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method, comprising the steps of:

A) providing an ink jet printer that is responsive to digital data signals;

B) loading said printer with an ink jet recording element comprising a support having thereon a porous image-receiving layer comprising particles and a poly(vinyl alcohol) binder, said particles comprising fumed alumina, and said binder having an average viscosity greater than 25 cp at 4% solids in an aqueous solution at 20° C.; said image-receiving layer also containing a crosslinker capable of crosslinking said binder;

C) loading said printer with an ink jet ink composition; and

D) printing on said image-receiving layer using said ink jet ink composition in response to said digital data signals.

2. The method of claim 1 wherein said average viscosity is from about 25 to about 100 cp.

3. The method of claim 1 wherein said average viscosity is from about 27 to about 60 cp.

4. The method of claim 1 wherein said crosslinker is an aldehyde, an acetal or a ketal.

5. The method of claim 1 wherein said crosslinker is 2,3-dihydroxy-1,4-dioxane.

6. The method of claim 1 wherein said support is polyethylene-coated paper.

7. The method of claim 1 wherein said image-receiving layer also contains a mordant.

8. The method of claim 1 wherein the weight ratio of said binder to said particles is from about 1:20 to about 1:5.

* * * * *